United States Patent [19]

Skelton et al.

[11] Patent Number: 4,909,127

[45] Date of Patent: Mar. 20, 1990

[54] BRAIDERS

[75] Inventors: John Skelton, Sharon; David Brookstein, Wellesley; Glenn A. Freitas, Easton, all of Mass.

[73] Assignee: Albany Research (UK) Limited, United Kingdom

[21] Appl. No.: 145,533

[22] Filed: Jan. 19, 1988

[30] Foreign Application Priority Data

Jan. 19, 1987 [GB] United Kingdom ..... 8701111

[51] Int. Cl.[4] ..... D04C 3/06; D04C 3/48

[52] U.S. Cl. ..... 87/33; 87/21; 87/41; 87/56; 87/57

[58] Field of Search ..... 87/5–8, 87/11, 13, 14–17, 20–22, 28–30, 33, 34, 41, 44, 50, 51, 54–57, 62

[56] References Cited

U.S. PATENT DOCUMENTS

| | | | |
|---|---|---|---|
| 871,004 | 11/1907 | Thun | 87/41 X |
| 1,885,676 | 11/1932 | Blaisdell | 87/30 X |
| 2,085,334 | 6/1937 | Richards | 87/30 |
| 2,879,687 | 3/1959 | Leimbach et al. | 87/11 X |
| 3,839,939 | 10/1974 | Wily | 87/21 X |
| 3,866,512 | 2/1975 | Berger | 87/33 X |
| 3,882,757 | 5/1975 | Weatherby | 87/57 |

*Primary Examiner*—John Petrakes

*Attorney, Agent, or Firm*—Ostrolenk, Faber, Gerb & Soffen

[57] ABSTRACT

A braider having a braider bed. The bed has first and second closed tracks defining an intersecting serpentine path. The tracks define an average path which is non-circular. A plurality of yarn package carriers travel along said tracks. Yarns fed from the packages form a braid at a location substantially central of the bed.

8 Claims, 1 Drawing Sheet

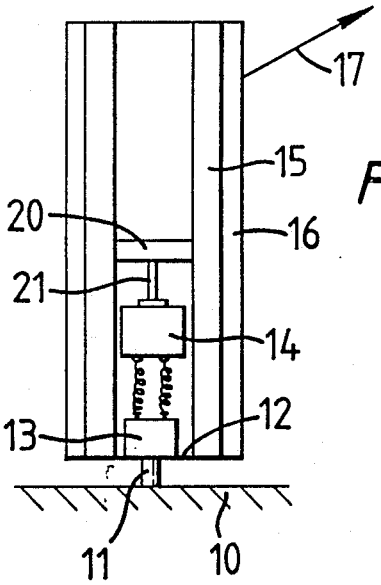
FIG. 1
FIG. 4
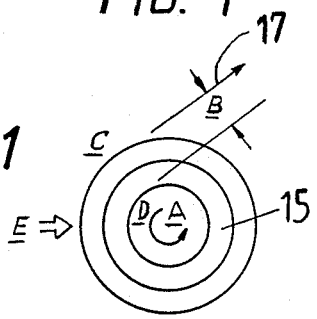
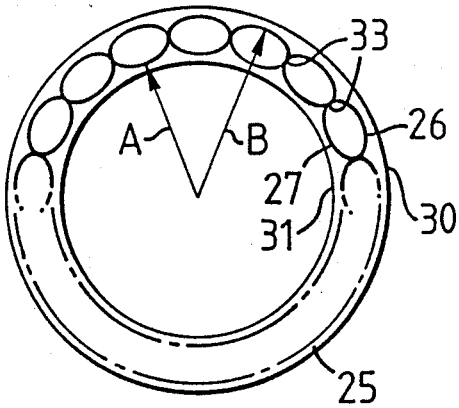
FIG. 2
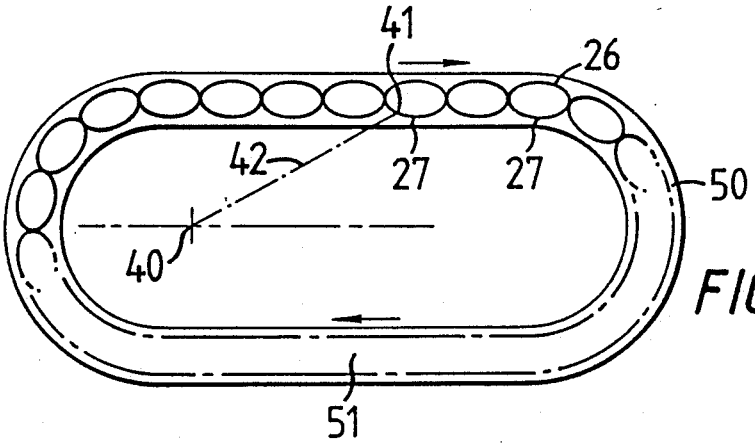
FIG. 3

BRAIDERS

DESCRIPTION

This invention relates to braiders and has particular reference to novel carriers for braiding machines and to a novel braiding machine per se.

The traditional braiding machine comprises a generally circular bed having a planar annular face, a pair of serpentine trackways within said face which intersect one with the other so that each track follows a serpentine path from an outer periphery to an inner periphery and back to an outer periphery and the second track follows a similar, but opposed serpentine path to pass from adjacent an inner periphery when the first track is near an outer periphery and vice versa. Each track is adapted to accomodate a plurality of carriers which travel along said tracks around the bed of the braiding machine. The carriers are typically moved by a sequence of epicyclic gears which control the movement of each carrier with precision to effect a braiding operation whereby alternate yarns pass under and over each other as the various carriers pass around their respective trackways. The relative rate of drawing-off the yarns at the braided article in the center of the bed and the transitional motion of the just formed braid controls the angle of braid between the yarns from which the braid is formed. An essential feature of the package carriers is the provision of lost motion means which is usually a floating eyelet spring loaded against the carrier body which eyelet moves towards and away from the package carried by the carrier to compensate for the change in radial distance as a given carrier moves from an outer portion of a trackway to the next adjacent inner portion.

It follows, therefore, because of the limitations that are imposed by changes in relative yarn distances from the supply eyelet to the point of braiding due to the changes in the radial distance of the carrier that the ability of the eyelet to float and to maintain a substantially constant tension on the yarn during braiding, effectively limits the relative sizes of the braider bed vis-a-vis the "throw" of each trackway from its outer path to its inner path. Furthermore, it is essential that any further variations in braid yarn length from the carrier to the point of braiding should be kept to an absolute minimum. When braiding generally regular articles, the limitation of a generally circular braider bed does not present any particular problem. With the increased use of braiding techniques for the production of fibrous preforms for composite applications, the need to braid irregularly shaped articles has resulted in the established circular braider presenting severe limitations.

Accordingly, the present invention provides a braider comprising a braider bed having first and second closed tracks each defining an intersecting serpentine path around said bed in the manner hereinbefore described, a plurality of yarn package carriers disposed in each track and means for driving said carriers along said serpentine path whereby in use yarns fed from said packages carried by said carriers form a braid in locations substantially central of the bed, characterised in that the tracks define an average path which is non-circular.

In a particular embodiment of the present invention, the braider may be provided with an oval or an elliptical carrier track path or may be provided with a link-shaped path comprising two substantially parallel bed portions, each inter-connected by substantially semi-circular portions.

The braider in accordance with the present invention may include package carriers provided with means for maintaining the yarn supplied thereto under substantially constant tension.

The invention also includes a package carrier for a braiding machine comprising a carrier base for a trackway of a braiding machine, package mounting means for mounting a yarn package on said carrier, yarn supply lead means for leading yarn supply from said package to the article to the braided characterised by torque motor means carried by said carrier base and adapted and arranged to apply a predetermined substantially constant torque to said package to maintain a substantially constant tension in said yarn during braiding.

Braiding an article toward one end of a braider having an elongate bed and associated trackways will result in a situation where, as a carrier is moving away from the article being braided, there will be a marked lengthening of the yarn span from the carrier and, as the carrier turns the curved portion to start returning generally towards the article being braided, the constant tension means provides a rewind of the yarn upon a package carried by said carrier.

In one embodiment of the present invention, the torque motor may be driven by an independent power supply carried by said carrier. Such a typical power supply may be a battery. The yarn package may be carried on a bobbin and the yarn tension may be maintained by means of a torque applicator acting between the motor output and the bobbin to maintain a substantially constant torque to the bobbin and substantially constant tension within the yarn.

Control means may be provided for controlling the applied torque in response to the amount of yarn on the package. The control means may include radio receiver means. The radio receiver means may be responsive to a photo monitoring means carried by the braider. The photo monitoring means may be adapted to sense the amount or thickness of the yarn on each bobbin as it passes a sense station and the control means may act on the motor means to control the amount of torque applied to the yarn supplied by the yarn package carried thereby.

The motor means may be a torque motor which is preferably mounted inside the core of a carrier or bobbin. The torque motor may be powered by a portable power system such as a battery.

An advantage of the invention is that the imposed torque imposes a final tension on the yarn which is independent of the yarn path length.

Following is a description by way of example only and with reference to the accompanying informal drawings of methods of carrying the invention into effect.

In the drawings:

FIG. 1 is a diagrammatic sectional view through a braider carrier in accordance with the invention.

FIG. 2 is a diagrammatic view of a typical circular braider bed of the prior art showing the two serpentine trackways intersecting to define what is sometimes referred to as the "maypole" path.

FIG. 3 is a diagrammatic view of a non-circular bed braider in accordance with the present invention.

FIG. 4 is a diagrammatic sectional view through a bobbin showing the torque acting thereon.

Turning now to FIG. 1, the carrier assembly shown therein comprises a base 10 adapted to be accommodated on the underside of the bed plate of a braider track, an upstanding stalk 11 supporting a carrier base 12. Carrier base 12 supports a battery and control system 13 which is operatively connected to a torque motor 14 supported substantially thereabove. Base 12 further supports a bobbin 15 rotatably mounted thereon and having on the outer surface thereof a yarn package 16 from which yarn 17 is supplied via a supply eyelet (not shown). The bobbin 15 is connected via a torque applicator 20 to the output shaft 21 of motor 14, the arrangement being such that operation of the motor maintains a specific reverse torque to the bobbin 15 thus maintaining a substantially constant tension in yarn 17. Thus, if the applied tension during braiding in yarn 17 is reduced, the torque motor 14 will drive bobbin 15 via torque applicator 20 to effectively wind yarn 17 back onto the yarn package 16. Where the applied tension is greater than the torque applied, slippage will occur between the torque applicator 20 and the output shaft 21 of motor 14 thereby resulting in yarn 17 being unwound from the package 16 and supplied to the braided article.

As illustrated in FIG. 4, the torque A applied to the bobbin 15 to maintain substantially constant tension in yarn 17 being supplied to a braiding location from the bobbin 15 must be functionally related to the distance B between the point C where the yarn 17 leaves the bobbin 15 and the point D where the tension inducing torque A is applied. That is, the distance B between the pint C where the yarn 17 leaves the bobbin 15 and the point D where the torque A is applied to the bobbin 15 is a lever arm of a force couple system. The distance B decreases as the yarn 17 is unwound from the bobbin 15. Thus, if constant tension is to be maintained, then the tension inducing torque A must decrease as the thickness of the yarn 17 on the bobbin 15 decreases (i.e., as the yarn 17 is unwound from the bobbin 15). Accordingly, control means may be provided for controlling the applied torque A in response to the amount of yarn 17 on the package. The control means may include radio receiver means. The radio receiver means may be responsive to a photo monitoring means illustrated schematically at E. The photo monitoring means E senses the amount or thickness of the yarn 17 on each bobbin 15 as it passes a sense station.

Turning now to FIG. 2, braider bed 25 has a pair of raceways 26, 27 therein, each of which executes a serpentine path so that as raceway 26 is juxtaposed an outer periphery 30 of bed 25, the second raceway 27 is juxtaposed inner surface 31 of bed 25. The raceways intersect at 33 at regular spaced intervals 33 about bed 25 so that a carrier (such as that shown in FIG. 1) carried with the underside 10 below the plate shown in FIG. 2 with the stem 11 and base 12 extending out of the raceway, the carrier follows a serpentine route around the raceway. In the prior art embodiment shown in FIG. 2 the radial difference between the inner raceway A, the outer raceway B for a given yarn package will result in a relative change of yarn length leaving the outlet eyelet of the carrier to the article being braided substantially at the center of circular bed 25 which is substantially constant, irrespective of the position of the carrier on bed 25.

The embodiment described in FIG. 1 overcomes the disadvantage of the traditional yarn carrier by providing facile means of providing substantially constant yarn tension independently of the rate of change of the path length from the package to the braided article.

FIG. 3 shows an embodiment of a braider in accordance with the invention in which the serpentine track 26 and 27 define a generally non-circular average path. In order to effect braiding, the trackways must be closed but virtually any shape of raceway is now possible using the yarn package carriers described with reference to FIG. 1.

Thus, when an article (indicated schematically by reference numeral 40 in FIG. 3) is braided towards one end of the braider bed of FIG. 3, a carrier progressing along raceway 27 at point 41 will have a yarn length 42. This length 42 increases as the carrier progresses along the raceway toward the remote end 50. As the length of yarn 42 increases, the yarn is being extended and unwound at a much greater rate than yarn is being used up to form the braided article 40.

When the same carrier 41 is at point 51 and is returning toward the article being braided 40, then the path length of yarn 42 will reduce much more rapidly than yarn is being used up to form the braided article 40. In these circumstances, the torque motor 14 will drive torque applicator 20 to rotate bobbin 15 to take up the surplus yarn while maintaining a constant tension in yarn 42.

This invention has considerable significance in that it provides for more sophisticated braiding techniques and braiding around shaped articles in a formation of braid reinforced composite materials.

We claim:

1. A braider, comprising:

(A) a braider bed having first and second closed tracks, said first and second closed tracks defining an intersecting serpentine path around said braider bed;

(B) a plurality of yarn package carriers for carrying packages of yarn, said yarn package carriers travelling along said first and second closed tracks; and (C) means for driving said yarn package carriers along said intersecting serpentine path to supply the yarns from the packages carried by said yarn package carriers to form a braid at a braiding location which is substantially central of said braider bed;

wherein said intersecting serpentine path defined by said first and second tracks defines an average path which is non-circular and closed; and wherein said yarn package carriers include means for maintaining the yarns under substantially constant tension by rewinding the yarns onto said yarn package carriers and allowing the yarns to be drawn off said yarn package carriers as said yarn package carriers are driven along said intersecting serpentine path.

2. A braider as claimed in claim 1, wherein said tracks define an average path which is oval or elliptical.

3. A braider as claimed in claim 1, wherein said path is a link shaped path comprising two substantially parallel bed portions each interconnected by substantially semi-circular portions.

4. A braider, comprising:

(A) a braider bed having first and second closed tracks, said first and second closed tracks defining an intersecting serpentine path around said braider bed;

(B) a plurality of yarn package carriers for carrying packages of yarn, said yarn package carriers travelling along said first and second closed tracks; and (C) means for driving said yarn package carriers along said intersecting serpentine path to supply the yarns from the packages carried by said yarn package carriers to form a braid at a braiding location which is substantially central of said braider bed;

wherein said intersecting serpentine path defined by said first and second tracks defines an average path which is non-circular and closed;

wherein said yarn package carriers include means for maintaining the yarns under substantially constant tension;

wherein each of said yarn package carriers comprises:

(i) a base for guiding said yarn package carrier along said tracks;

(ii) means for carrying the yarn package on said base;

(iii) yarn supply means for leading yarn from the yarn package to said braiding location; and (iv) constant torque means for applying a predetermined, substantially constant torque to the yarn package to maintain a substantially constant tension in the yarn during braiding; and wherein the yarn package is a bobbin;

said braider further comprising:

(D) sensing means for sensing the amount of yarn on the bobbin; and (E) control means for controlling said constant torque means as a function of the amount of yarn on the bobbin.

5. A braider, comprising:

(A) a braider bed having first and second closed tracks, said first and second closed tracks defining an intersecting serpentine path around said braider bed;

(B) a plurality of yarn package carriers for carrying packages of yarn, said yarn package carriers travelling along said first and second closed tracks, each of said yarn package carriers comprising constant torque means for applying a predetermined, substantially constant torque to the yarn package to maintain a substantially constant tension in the yarn during braiding, said constant torque means comprising a motor for driving a torque applicator for controlling the rotation of the yarn package; and (C) means for driving said yarn package carriers along said intersecting serpentine path to supply the yarns from the packages carried by said yarn package carriers to form a braid at a braiding location which is substantially central of said braider bed;

wherein said intersecting serpentine path defined by said first and second tracks defines an average path which is non-circular and closed; and wherein said yarn package carriers include means for maintaining the yarns under substantially constant tension.

6. A braider as claimed in claim 5, wherein each of said yarn package carriers comprises:

(i) a base for guiding said yarn package carrier along said tracks;

(ii) means for carrying the yarn package on said base; and (iii) yarn supply means for leading yarn from the yarn package to said braiding location.

7. A braider as claimed in claim 6, wherein said motor is a battery operated motor.

8. A braider as claimed in claim 6, wherein the yarn package is a bobbin.

* * * * *